US007940226B2

(12) United States Patent
Tsubaki et al.

(10) Patent No.: US 7,940,226 B2
(45) Date of Patent: May 10, 2011

(54) SURFACE-MOUNT ANTENNA AND ANTENNA DEVICE

(75) Inventors: Nobuhito Tsubaki, Sagamihara (JP); Kazunari Kawahata, Yokohama (JP)

(73) Assignee: Murata Manufacturing Co., Ltd. (JP)

( * ) Notice: Subject to any disclaimer, the term of this patent is extended or adjusted under 35 U.S.C. 154(b) by 342 days.

(21) Appl. No.: 12/331,564

(22) Filed: Dec. 10, 2008

(65) Prior Publication Data

US 2009/0109106 A1 Apr. 30, 2009

Related U.S. Application Data

(63) Continuation of application No. PCT/JP2007/061458, filed on Jun. 6, 2007.

(30) Foreign Application Priority Data

Jun. 12, 2006 (JP) ..... 2006-162913

(51) Int. Cl.
*H01Q 9/00* (2006.01)

(52) U.S. Cl. ..... 343/745

(58) Field of Classification Search ..... 343/745, 343/745 MS, 702, 850; 361/188; 455/41.1
See application file for complete search history.

(56) References Cited

U.S. PATENT DOCUMENTS

| | | | | |
|---|---|---|---|---|
| 5,694,134 | A | 12/1997 | Barnes | |
| 5,898,403 | A * | 4/1999 | Saitoh et al. | 343/700 MS |
| 7,132,984 | B2 * | 11/2006 | Kameda et al. | 343/700 MS |
| 7,180,473 | B2 * | 2/2007 | Horie et al. | 343/909 |
| 7,675,729 | B2 * | 3/2010 | Anthony et al. | 361/118 |
| 2002/0149428 | A1 | 10/2002 | Toncich et al. | |
| 2008/0064331 | A1 * | 3/2008 | Washiro | 455/41.1 |

FOREIGN PATENT DOCUMENTS

| | | |
|---|---|---|
| JP | 08-509103 | 9/1996 |
| JP | 10-163916 | 6/1998 |
| JP | 11-154821 | 6/1999 |
| JP | 2000-341027 | 12/2000 |
| JP | 2001-257528 | 9/2001 |
| JP | 2004-526379 | 8/2004 |
| JP | 2005-502227 | 1/2005 |
| WO | 94-13028 | 6/1994 |
| WO | 02/084798 | 10/2002 |
| WO | 02/087016 | 10/2002 |

OTHER PUBLICATIONS

Written Opinion issued Sep. 4, 2007 with English-language translation.
International Search Report issued Sep. 4, 2007 with English-language translation.

* cited by examiner

*Primary Examiner* — Huedung Mancuso
(74) *Attorney, Agent, or Firm* — Ostrolenk Faber LLP

(57) ABSTRACT

A ground electrode is formed on the lower surface of a ferroelectric substrate, a control electrode including capacitor electrodes and an inductor electrode is formed on the upper surface of the ferroelectric substrate, and an upper-surface radiating electrode and an end-surface radiating electrode are formed on a paraelectric substrate. The shapes and dimensions of the ferroelectric substrate, paraelectric substrate, and radiating electrodes are determined such that when the ferroelectric substrate and the paraelectric substrate are stacked in layers, a circuit including the radiating electrodes resonates at frequencies outside a frequency band exhibiting frequency dispersion of a dielectric constant.

10 Claims, 12 Drawing Sheets

SURFACE-MOUNT ANTENNA AND ANTENNA DEVICE

CROSS-REFERENCE TO RELATED APPLICATIONS

This is a continuation under 35 U.S.C. §111(a) of PCT/JP2007/061458 filed Jun. 6, 2007, and claims priority of JP2006-162913 filed Jun. 12, 2006, both incorporated by reference.

BACKGROUND

1. Technical Field

The present disclosure relates to a surface-mount antenna and an antenna device including the same.

2. Background Art

Patent Document 1 and Patent Document 2 disclose antennas that operate over a plurality of frequency bands by using a ferroelectric material as a dielectric.

Ferroelectrics have a dielectric constant that changes in response to a voltage applied thereto. The disclosed antennas use this property of ferroelectrics to change the resonant frequency so as to be operable over a wider range of frequencies.

FIG. 1A illustrates a configuration of an antenna disclosed in Patent Document 1. Referring to FIG. 1A, a ground electrode 11 and an inverted-F radiating electrode 12 form an inverted-F antenna, to which power is fed at a feeding point E. At the same time, a ferroelectric component 13 is disposed between an open end of the radiating electrode 12 and the ground electrode 11.

The ferroelectric component 13 disposed between the open end of the radiating electrode 12 and the ground electrode 11 has a dielectric constant that changes in response to a voltage applied thereto. Therefore, the resonant frequency of the antenna provided with the ferroelectric component 13 can be tuned by application of a voltage. However, the antenna suffers high loss because the ferroelectric component is disposed locally at a point of maximum electric field.

FIG. 1B illustrates a configuration of an antenna disclosed in Patent Document 2. The antenna is a so-called patch antenna in which a laminated structure including a ferroelectric layer 23 and paraelectric layers 24 is disposed between a ground electrode 21 and a radiating electrode 22. In this configuration, to change the dielectric constant of the ferroelectric layer by a necessary amount by applying a DC voltage, it is necessary to reduce the thickness of the paraelectric layers. Also in this configuration, to improve the antenna efficiency, it is necessary to reduce the thickness of the ferroelectric layer.

Patent Document 1: PCT Japanese Translation Patent Publication No. 2004-526379

Patent Document 2: PCT Japanese Translation Patent Publication No. 2005-502227

The above-described conventional antennas using ferroelectrics have the following problems to be solved.

(a) Basically, since ferroelectrics typically suffer high loss in high frequency bands, high-gain antennas cannot be obtained. In particular, forming a radiating electrode on the surface of a ferroelectric substrate causes significant gain degradation due to loss resulting from the use of ferroelectrics.

(b) As illustrated in FIG. 1A, when the antenna has a laminated structure of ferroelectric and paraelectric layers and a voltage is applied in the laminating direction, the gain degradation described above can be reduced. However, due to a reduction in the amount of change in capacitance with respect to an applied voltage, a variable frequency range will be narrowed. Therefore, the antenna cannot cover a wide range of frequencies.

(c) In the antennas with conventional configurations illustrated in FIGS. 1A and 1B, when the capacitance between the radiating electrode and the ground electrode is changed by applying a voltage, since the change in capacitance causes a change in impedance, the impedance matching state changes with changes in resonant frequency. That is, the variable range of resonant frequencies in the impedance matching state is narrowed. Thus, it is difficult to achieve impedance matching over a wide range of frequencies.

SUMMARY

Disclosed herein are a surface-mount antenna and an antenna device that have low-loss, high-gain, and low-reflection characteristics and can be used over a wider range of frequencies.

A surface-mount antenna is advantageously configured as follows.

(1) The surface-mount antenna includes a ferroelectric substrate and a paraelectric substrate that are stacked in layers, wherein the ferroelectric substrate is provided with a control electrode and a ground electrode, while the ferroelectric substrate, the ground electrode, and the control electrode constitute an impedance matching circuit; and a surface of the paraelectric substrate is provided with radiating electrodes and the shapes and dimensions of the ferroelectric substrate, paraelectric substrate, and radiating electrodes are determined such that when the paraelectric substrate and the ferroelectric substrate are stacked in layers. Thus, a low-loss antenna having a variable resonant frequency can be realized.

(2) The ferroelectric substrate may have two principal surfaces substantially parallel to each other, and for example, the control electrode and the ground electrode are formed at predetermined positions of the two principal surfaces such that the ferroelectric substrate is interposed between the control electrode and the ground electrode.

(3) For example, there may be a plurality of ferroelectric substrates stacked in layers, each ferroelectric substrate having two principal surfaces substantially parallel to each other, and the control electrode may be formed on corresponding principal surfaces of the plurality of ferroelectric substrates such that capacitances generated between the ground electrode and the control electrodes are connected in parallel.

(4) The plurality of ferroelectric substrates may include, for example, at least two ferroelectric substrates with different ferroelectric properties.

(5) The ground electrode may be formed on one principal surface (lower surface) of the ferroelectric substrate distant from the paraelectric substrate. The control electrode includes a first capacitor electrode, a second capacitor electrode, and an inductor electrode connected to the second capacitor electrode or a connecting portion connected to an external inductor. The first and second capacitor electrodes face each other on the other principal surface (upper surface) of the ferroelectric substrate to form a capacitance therebetween, while individually facing the ground electrode to form capacitances between the ground electrode and the first and second capacitor electrodes. The radiating electrodes include an electrode extending from one principal surface (upper surface) of the paraelectric substrate distant from the ferroelectric substrate to an end surface of the paraelectric substrate. The electrode on the end surface is connected to the first capacitor electrode.

(6) The ground electrode may be formed on one principal surface (lower surface) of the ferroelectric substrate distant from the paraelectric substrate. The control electrode includes, on the other principal surface (upper surface) of the ferroelectric substrate, a first capacitor electrode, a second capacitor electrode, and an inductor electrode connecting the first and second capacitor electrodes individually facing the ground electrode to form capacitances between the ground electrode and the first and second capacitor electrodes.

The radiating electrodes may include an electrode extending from one principal surface (upper surface) of the paraelectric substrate distant from the ferroelectric substrate to an end surface of the paraelectric substrate. The electrode on the end surface is connected to the first or second capacitor electrode.

(7) The ground electrode may be formed on one principal surface (lower surface) of the ferroelectric substrate distant from the paraelectric substrate. The control electrode includes, on the other principal surface (upper surface) of the ferroelectric substrate, a first capacitor electrode, a second capacitor electrode, and an inductor electrode. The first and second capacitor electrodes individually face the ground electrode to form capacitances between the ground electrode and the first and second capacitor electrodes. The inductor electrode forms capacitances between the inductor electrode and the first and second capacitor electrodes and forms an inductor between the inductor electrode and the ground electrode.

The radiating electrodes may include an electrode extending from one principal surface (upper surface) of the paraelectric substrate distant from the ferroelectric substrate to an end surface of the paraelectric substrate. The electrode on the end surface is connected to the first or second capacitor electrode.

(8) The ground electrode may be formed on one principal surface (lower surface) of the ferroelectric substrate distant from the paraelectric substrate. The control electrode includes a first capacitor electrode pair, a second capacitor electrode pair, a capacitor electrode, a first inductor electrode, and a second inductor electrode. The first and second capacitor electrode pairs each have first and second electrodes facing each other on the other principal surface (upper surface) of the ferroelectric substrate to form a capacitance therebetween. The capacitor electrode is connected between the first and second capacitor electrode pairs and faces the ground electrode to form a capacitance between the capacitor electrode and the ground electrode. The first and second inductor electrodes are connected to the first and second capacitor electrode pairs, respectively.

The radiating electrodes may include an electrode extending from one principal surface (upper surface) of the paraelectric substrate distant from the ferroelectric substrate to an end surface of the paraelectric substrate. The electrode on the end surface is connected to the first or second inductor electrode.

(9) The ground electrode may be formed on one principal surface (lower surface) of the ferroelectric substrate distant from the paraelectric substrate. The control electrode includes a first capacitor electrode pair, a second capacitor electrode pair, a third capacitor electrode pair, and an inductor electrode. The first, second, and third capacitor electrode pairs each have first and second electrodes facing each other on the other principal surface (upper surface) of the ferroelectric substrate to form a capacitance therebetween. The first electrodes of the first, second, and third capacitor electrode pairs are connected to each other to form a common electrode. The inductor electrode is connected between the ground electrode and the second electrode of the third capacitor electrode pair.

The radiating electrodes may include an electrode extending from one principal surface (upper surface) of the paraelectric substrate distant from the ferroelectric substrate to an end surface of the paraelectric substrate. The electrode on the end surface is connected to the second electrode of the first or second capacitor electrode pair.

(10) An antenna device of the present invention may include a surface-mount antenna with any one of the above-described configurations and a circuit for applying a DC control voltage to the control electrode of the surface-mount antenna.

The disclosed antenna has the following effects.

(1) Since the radiating electrodes are provided on the paraelectric substrate and are distant from the ferroelectric substrate, loss caused by the presence of the ferroelectric substrate can be reduced. Moreover, since the circuit including the radiating electrodes resonates at frequencies outside the frequency band exhibiting frequency dispersion of the dielectric constant of the ferroelectric substrate, a low-loss antenna having a variable resonant frequency can be realized.

Additionally, since the impedance of the impedance matching circuit formed by the ferroelectric substrate, the ground electrode, and the control electrode changes according to the frequency, it is possible to achieve impedance matching and obtain high-gain and low-reflection characteristics over a wide range of frequencies.

(2) If the control electrode and the ground electrode are arranged such that the ferroelectric substrate is interposed therebetween, a large capacitance can be ensured between the control electrode and the ground electrode. This increases a change in capacitance in response to a change in applied control voltage, and thus, an antenna operable over a wider range of frequencies can be realized.

(3) If a plurality of ferroelectric substrates is stacked in layers and a plurality of control electrodes is formed such that capacitances generated between the ground electrode and the control electrodes are connected in parallel, a change in capacitance in response to a change in applied control voltage can be increased. Thus, an antenna operable over a wider range of frequencies can be realized.

(4) If the plurality of ferroelectric substrates includes at least two ferroelectric substrates with different ferroelectric properties, a characteristic of a change in resonant frequency in response to a change in control voltage can be easily adjusted to a predetermined value.

(5) If the control electrodes face each other on a principal surface (upper surface) of the ferroelectric substrate to form a capacitance therebetween and also form capacitances between the ground electrode and the control electrodes, a large capacitance per unit area can be ensured. A circuit formed by the capacitances between the ground electrode and the control electrodes, the capacitance along the surface of the ferroelectric substrate, and an inductor act as an impedance matching circuit. With this impedance matching circuit, because of the voltage dependence of the dielectric constant of the ferroelectric substrate, when a resonant frequency is shifted by application of a control voltage, impedance matching and high-gain and low-reflection characteristics can be obtained over a wide range of frequencies responsive to the applied control voltage.

(6) If there are provided the first and second capacitor electrodes and the inductor electrode connecting the first and second capacitor electrodes which individually form capacitances between the ground electrode and the first and second capacitor electrodes with the ferroelectric substrate interposed, a circuit formed by the inductor electrode and two capacitors formed by the first and second capacitor electrodes acts as a CLC i-type impedance matching circuit. With this impedance matching circuit, because of the voltage dependence of the dielectric constant of the ferroelectric substrate, when a resonant frequency is shifted by application of a control voltage, impedance matching and high-gain and low-reflection characteristics can be obtained over a wide range of frequencies responsive to the applied control voltage.

(7) If the ferroelectric substrate is provided with the first and second capacitor electrodes individually forming capacitances between the ground electrode and the first and second capacitor electrodes and the inductor electrode forming capacitances between the inductor electrode and the first and second capacitor electrodes and also forming an inductor between the inductor electrode and the ground electrode, while a radiating electrode formed on the paraelectric substrate is connected to one of the capacitor electrodes, the resulting circuit acts as a CLC T-type impedance matching circuit. With this impedance matching circuit, because of the voltage dependence of the dielectric constant of the ferroelectric substrate, when a resonant frequency is shifted by application of a control voltage, impedance matching and high-gain and low-reflection characteristics can be obtained over a wide range of frequencies responsive to the applied control voltage.

(8) If the ferroelectric substrate is provided with the first and second capacitor electrode pairs each having the first and second electrodes facing each other along the principal surface of the ferroelectric substrate to form a capacitance therebetween, the capacitor electrode connected between the first and second capacitor electrode pairs and forming a capacitance between the capacitor electrode and the ground electrode, and the first and second inductor electrodes connected to the first and second capacitor electrode pairs, respectively, while a radiating electrode formed on the paraelectric substrate is connected to one of the inductor electrodes, the resulting circuit acts as an LCL T-type impedance matching circuit. With this impedance matching circuit, because of the voltage dependence of the dielectric constant of the ferroelectric substrate, when a resonant frequency is shifted by application of a control voltage, impedance matching and high-gain and low-reflection characteristics can be obtained over a wide range of frequencies responsive to the applied control voltage.

(9) If the ferroelectric substrate is provided with the first and second capacitor electrode pairs each having the first and second electrodes facing each other along the principal surface of the ferroelectric substrate to form a capacitance therebetween, the capacitor electrode connected between the first and second capacitor electrode pairs and forming a capacitance between the capacitor electrode and the ground electrode, and the inductor electrode connected between the capacitor electrode and the ground, while a radiating electrode formed on the paraelectric substrate is connected to the inductor electrode, the resulting circuit acts as a CLC T-type impedance matching circuit. With this impedance matching circuit, because of the voltage dependence of the dielectric constant of the ferroelectric substrate, when a resonant frequency is shifted by application of a control voltage, impedance matching and high-gain and low-reflection characteristics can be obtained over a wide range of frequencies responsive to the applied control voltage.

Other features and advantages will become apparent from the following description of embodiments, which refers to the accompanying drawings.

DETAILED DESCRIPTION

Reference Numerals

Figure 1A:
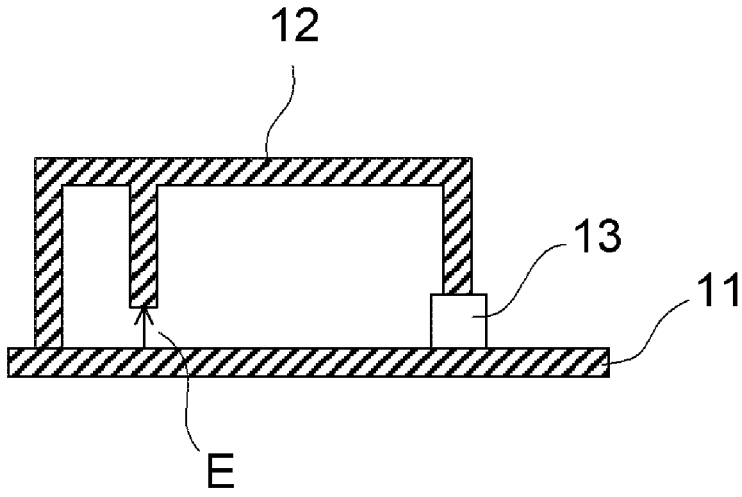
FIGS. 1A-1B illustrates configurations of antennas described in Patent Document 1 and Patent Document 2.
Figure 1B:
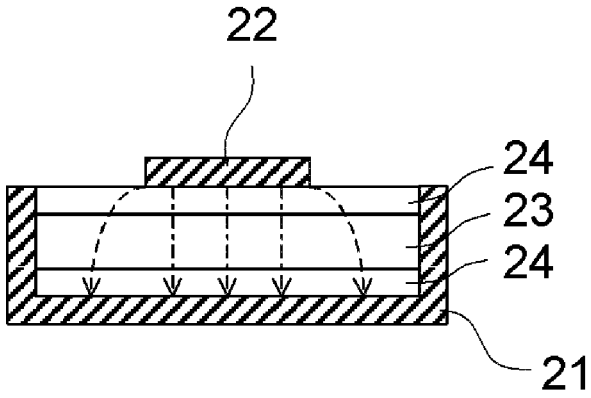
PRIOR ART FIG.1B

30 ferroelectric substrate
31 ground electrode
32 first capacitor electrode
33 second capacitor electrode
34 inductor electrode
35, 36, 37 extraction electrodes
40 paraelectric substrate
41 upper-surface radiating electrode
42 end-surface radiating electrode
43 extraction electrodes
50, 60 ferroelectric substrates
51, 61 electrodes
70 ferroelectric substrate
71 ground electrode
72, 73 capacitor electrodes
74 inductor electrode
75, 76 extraction electrodes
80 ferroelectric substrate
81 ground electrode
82, 83 capacitor electrodes
84 inductor electrode
90 ferroelectric substrate
91 ground electrode
92, 93 inductor electrodes
94, 95, 97 capacitor electrode pairs
96 capacitor electrode

98 inductor electrode
101 surface-mount antenna

First Embodiment

Configurations of a surface-mount antenna and an antenna device according to a first embodiment will now be described with reference to FIG. 2A to FIG. 4.

Figure 2A:
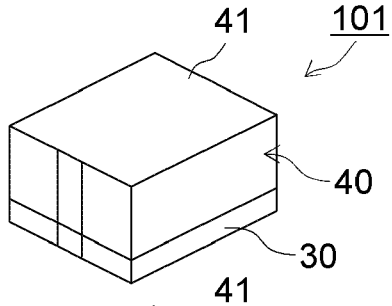
FIGS. 2A-2D illustrate configurations of a surface-mount antenna and an antenna device according to a first embodiment.
Figure 2B:
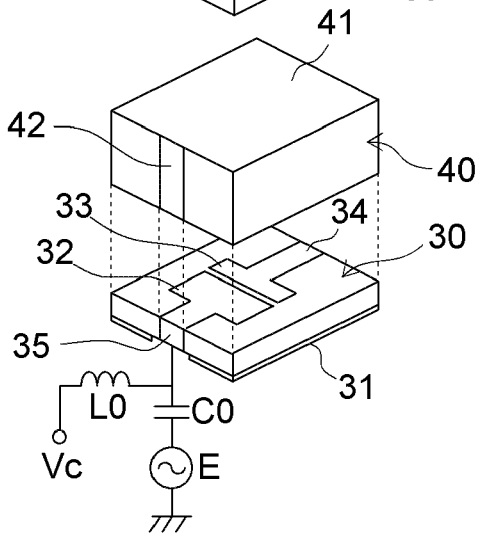
Figure 2C:
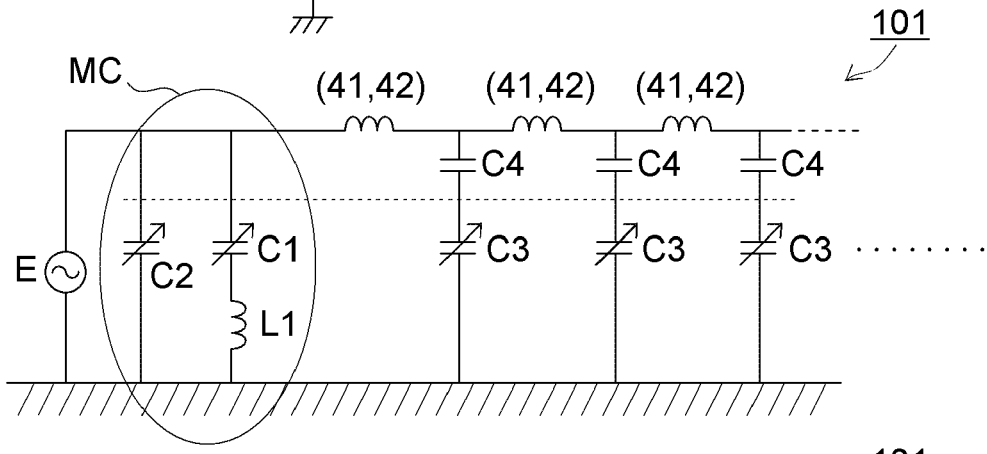
Figure 2D:
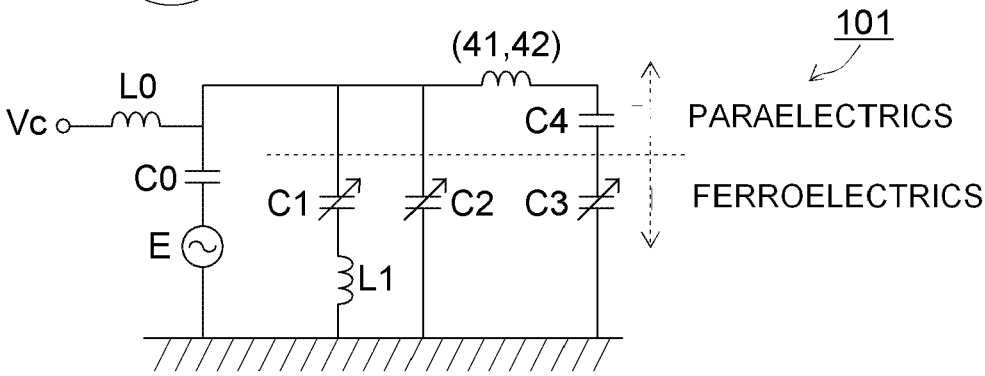

FIG. 2A is a perspective view of the surface-mount antenna, FIG. 2B is an exploded perspective view of the surface-mount antenna, FIG. 2C is an equivalent circuit diagram of the surface-mount antenna, and FIG. 2D is an equivalent circuit diagram of the antenna device including the surface-mount antenna.

A surface-mount antenna 101 of the first embodiment includes a ferroelectric substrate 30 and a paraelectric substrate 40 that are stacked in layers.

The ferroelectric substrate 30 is in the shape of a plate-like rectangular parallelepiped. A ground electrode 31 is formed on substantially one entire principal surface (lower surface in the drawing) of the ferroelectric substrate 30. A control electrode including first and second capacitor electrodes 32 and 33 and an inductor electrode 34 is formed on the other principal surface (upper surface in the drawing) of the ferroelectric substrate 30. The two capacitor electrodes 32 and 33 face each other along the principal surface of the ferroelectric substrate 30 to form a capacitance therebetween. At the same time, the two capacitor electrodes 32 and 33 individually form capacitances with the ground electrode 31, with the ferroelectric substrate 30 interposed between the ground electrode 31 and the capacitor electrodes 32 and 33. An end of the inductor electrode 34 is connected to the second capacitor electrode 33.

An extraction electrode 35 connected to the first capacitor electrode 32 extends from an end surface (located at the left front of the drawing) to part of the lower surface of the ferroelectric substrate 30. Another end surface (located at the right rear of the drawing) of the ferroelectric substrate 30 is provided with an extraction electrode extending from an end of the inductor electrode 34 to the ground electrode 31 on the lower surface.

The paraelectric substrate 40 has substantially the same planar shape as that of the ferroelectric substrate 30 and is in the shape of a plate-like rectangular parallelepiped. An upper-surface radiating electrode 41 is formed over substantially one entire principal surface (upper surface in the drawing) of the paraelectric substrate 40. An end-surface radiating electrode 42 connected to the upper-surface radiating electrode 41 is formed on an end surface (located at the left front of the drawing) of the paraelectric substrate 40. As illustrated in FIG. 2A, with the ferroelectric substrate 30 and the paraelectric substrate 40 stacked in layers, the end-surface radiating electrode 42 is electrically connected to the extraction electrode 35 of the ferroelectric substrate 30. The upper-surface radiating electrode 41 and the end-surface radiating electrode 42 form an L-shaped antenna (antenna unit).

A transmission signal E is fed through a capacitor Co to the extraction electrode 35. To shift the corresponding frequency by application of a control voltage, a capacitor Co for cutting off direct current is provided and a control voltage Vc is applied through an inductor Lo to the extraction electrode 35. When this surface-mount antenna is used as a receiving antenna, the signal E represents a voltage generated at a feeding point.

FIG. 2B illustrates an example in which an end of the inductor electrode 34 is grounded through the extraction electrode (not shown) formed on one end surface of the ferroelectric substrate 30 to the ground electrode 31 on the lower surface. Alternatively, if an inductor is externally provided to adjust an inductance value of an inductor L1 of FIG. 2D to a predetermined value, an extraction electrode (not shown) which allows an end of the inductor electrode 34 to be extracted from an end surface to part of the lower surface of the ferroelectric substrate 30 (i.e., the extraction electrode being insulated from the ground electrode 31) may be formed and used as a connecting portion for connection to the inductor externally provided.

As illustrated in FIG. 2C, the radiating electrodes (41, 42) can be represented as inductors. Capacitors C4 correspond to capacitances generated between the upper-surface radiating electrode 41 and a set of the second capacitor electrode 33 and inductor electrode 34 on the ferroelectric substrate 30, with the paraelectric substrate 40 interposed. Capacitors C3 correspond to capacitances generated between the ground electrode 31 and the set of the second capacitor electrode 33 and inductor electrode 34 on the ferroelectric substrate 30.

Thus, a circuit (antenna unit) including the radiating electrodes can be represented as LC distributed-constant transmission lines based on the paraelectric substrate 40 having the radiating electrodes (41, 42) and the ferroelectric substrate 30 having the control electrode and the ground electrode.

A capacitor C2 corresponds to a capacitance generated between the first capacitor electrode 32 and the ground electrode 31. A capacitor C1 corresponds to a capacitance generated between the first and second capacitor electrodes 32 and 33 along the principal surface of the ferroelectric substrate 30. The inductor L1 corresponds to the inductor formed by the inductor electrode 34. A circuit formed by the capacitors C1 and C2 and the inductor L1 acts as an impedance matching circuit MC.

FIG. 2D is an equivalent circuit diagram illustrating an antenna device including an external circuit. FIG. 2D illustrates the circuit of FIG. 2C as a lumped constant circuit.

In FIG. 2D, the radiating electrodes (41, 42) and the capacitors C3 and C4 represent the antenna unit. Thus, since the radiating electrodes (41, 42) and the capacitors C2, C3, and C4 constitute a resonant circuit and the capacitors C2 and C3 are formed in the ferroelectric substrate 30, the voltage dependence of the dielectric constant can be used, as described below.

Since the capacitors C1 and C2 in the impedance matching circuit MC are also formed in the ferroelectric substrate 30, the voltage dependence of the dielectric constant can be used.

FIGS. 3A-3D illustrate the frequency dispersion of the dielectric constant of ferroelectrics, a frequency characteristic of loss, and a characteristic of control voltage versus dielectric constant during application of a voltage. FIG. 4 illustrates an antenna characteristic depending on whether the voltage is applied. FIG. 4 illustrates a characteristic of reflection loss S11.

Figure 3A:
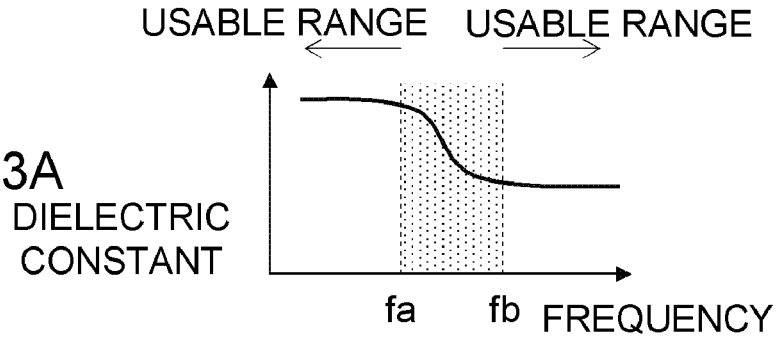
FIGS. 3A-3D illustrate a frequency characteristic of a dielectric constant of ferroelectrics, a frequency characteristic of loss, an applied voltage characteristic of the dielectric constant, and a relationship between an applied voltage and the frequency characteristic of the dielectric constant.
Figure 4:
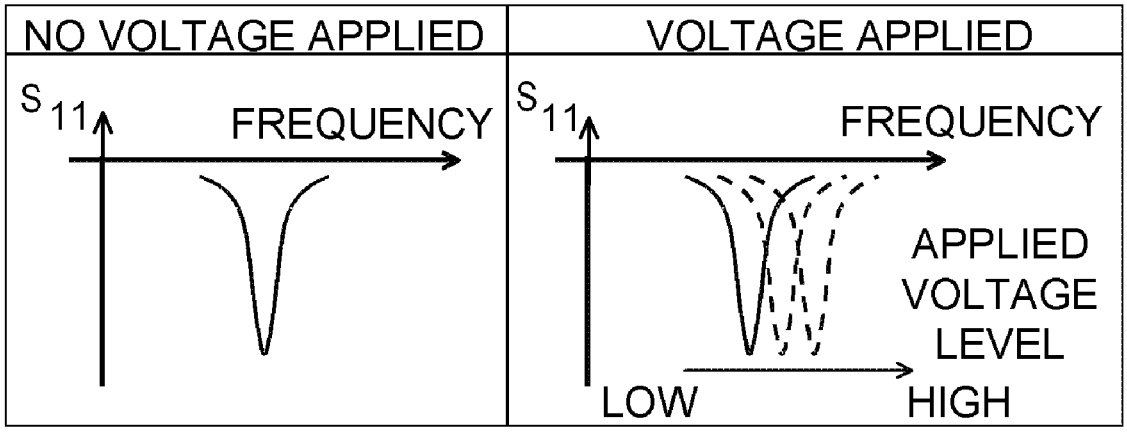
FIG. 4 illustrates a difference in characteristic depending on whether there is a frequency dispersion of dielectric constant and whether a voltage is applied.

FIG. 3A illustrates a profile of the dielectric constant of the ferroelectric substrate 30 versus frequency. The relationship between a dielectric constant $\in a$ at frequencies below fa and a dielectric constant $\in b$ at frequencies above fb can be expressed as $\in a > \in b$. In the frequency range of fa to fb, there is exhibited a gradual frequency dispersion characteristic in which the dielectric constant gradually decreases as the frequency increases.

Thus, as the frequency increases, the dielectric constant between the ground electrode and the radiating electrodes (41, 42) decreases, and then, the capacitance of the capacitor C3 illustrated in FIG. 2C decreases (i.e., the electrical volume of the antenna decreases). Therefore, if the antenna is configured such that the circuit including the radiating electrodes (41, 42) resonates at frequencies lower and higher than the frequency band exhibiting the frequency dispersion of the dielectric constant, the antenna can cover a wide range of frequencies.

Figure 3B:
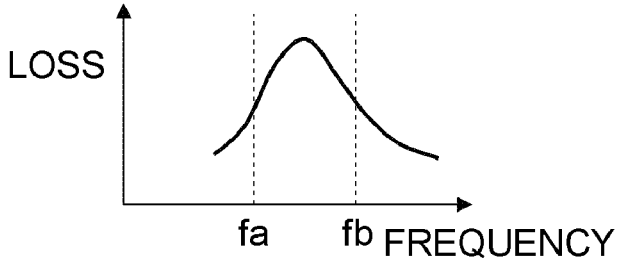

FIG. 3B illustrates a frequency characteristic of loss. By using frequencies outside the frequency band exhibiting the frequency dispersion of the dielectric constant, high-gain characteristics can be achieved at the frequencies used.

Since the capacitors C1 and C2 in the impedance matching circuit MC illustrated in FIG. 2C are also formed in the ferroelectric substrate 30, the impedance to be matched changes as the signal frequency changes. That is, as the frequency increases, a parallel capacitance in the impedance matching circuit MC decreases, and thus, a frequency at which the impedance matching is achieved increases. Therefore, the impedance matching can be achieved over a wide range of frequencies on both sides of the frequency band exhibiting the frequency dispersion of the dielectric constant. Thus, high-gain and low-reflection characteristics can be obtained over a wide range of frequencies.

Figure 3C:
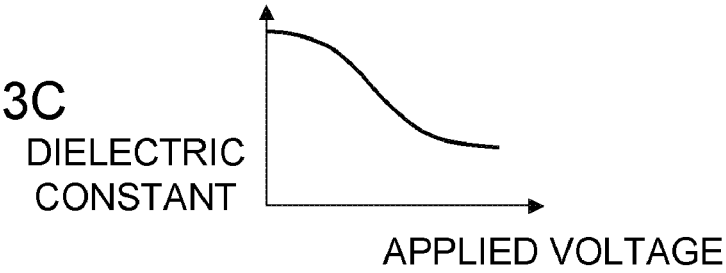

FIG. 3C illustrates a relationship between an applied voltage and the dielectric constant of the ferroelectric substrate 30 during application of a control voltage to the surface-mount antenna. As illustrated, as the applied voltage increases, the dielectric constant of the ferroelectric substrate 30 decreases.

Figure 3D:
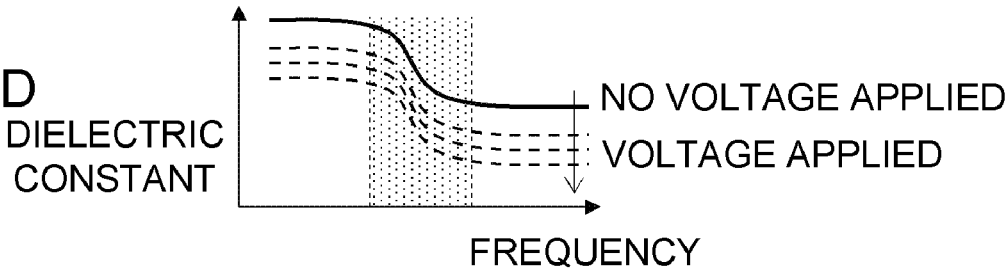

FIG. 3D illustrates a synthesis of the frequency dispersion of the dielectric constant (see FIG. 3A) and the characteristic of dielectric constant versus applied voltage (see FIG. 3C). As illustrated, the overall dielectric constant decreases in response to a control voltage applied.

Thus, by applying a control voltage to control the dielectric constant of ferroelectrics with a resonant state maintained at frequencies outside the frequency range of fa to fb, it is possible to perform tuning and to shift a waveform in a matched state.

Second Embodiment

A surface-mount antenna according to a second embodiment will now be described with reference to FIGS. 5A-5B.

Figure 5A:
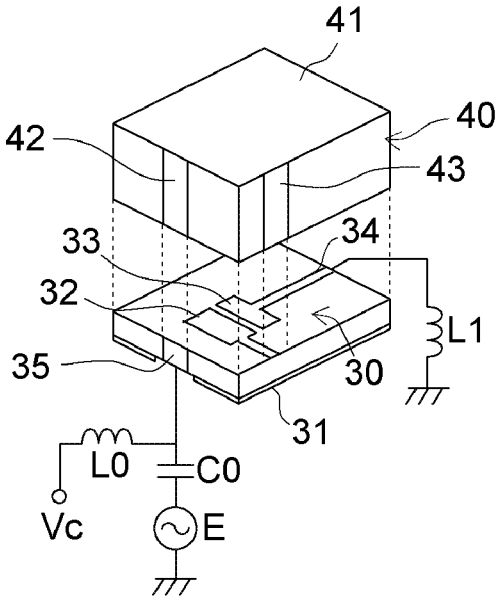
FIGS. 5A-5B illustrate configurations of surface-mount antennas and antenna devices according to a second embodiment.
Figure 5B:
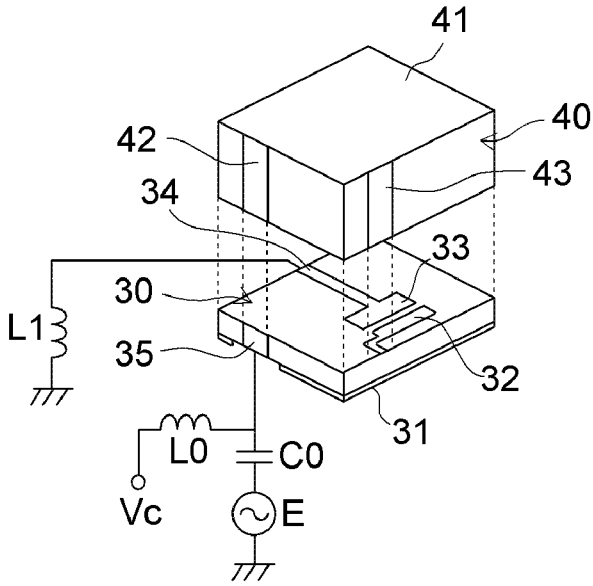

FIG. 5A and FIG. 5B are exploded perspective views of two types of surface-mount antennas.

The surface-mount antennas of both FIG. 5A and FIG. 5B are different from the surface-mount antenna of FIG. 2 in that a connection between the upper-surface radiating electrode 41 and the first capacitor electrode 32 is made through a path different from that for feeding power to the radiating electrodes. In other words, the upper-surface radiating electrode 41 is electrically connected to an end of the first capacitor electrode 32 through an extraction electrode 43 formed on an end surface (located at the right front of the drawing) of the paraelectric substrate 40.

In the examples illustrated in FIGS. 5A-5B, an end of the inductor electrode 34 serves as an inductor connector, to which an external inductor L1 is connected. The surface-mount antennas illustrated in FIG. 5A and FIG. 5B are different from each other in terms of orientation of the two capacitor electrodes 32 and 33 and inductor electrode 34 on the ferroelectric substrate 30 and location of the end-surface radiating electrode 42.

As described above, the pattern of the control electrode formed on the ferroelectric substrate 30 and the path for feeding power to the radiating electrodes formed on the paraelectric substrate 40 illustrated in FIG. 5A and FIG. 5B are different from those illustrated in FIGS. 2A-2D. However, the surface-mount antennas of FIG. 5A and FIG. 5B can be represented by equivalent circuits identical to those of FIG. 2C and FIG. 2D and have substantially the same effects as those of the first embodiment.

Third Embodiment

A surface-mount antenna according to a third embodiment will now be described with reference to FIG. 6.

Figure 6A:
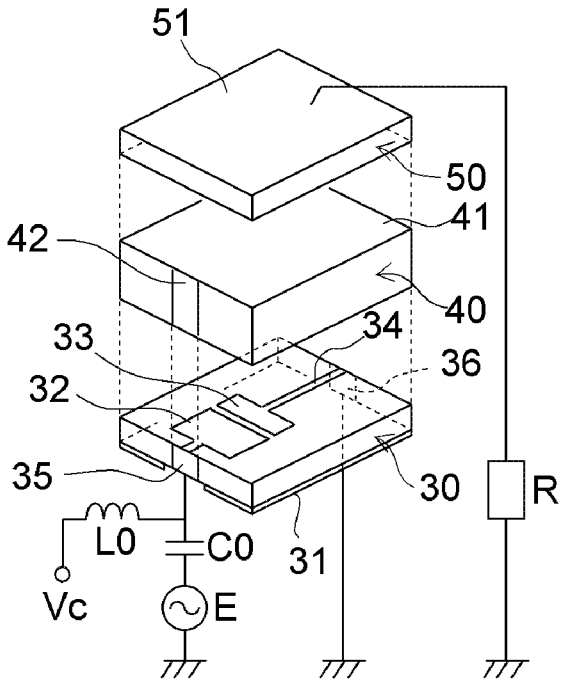
FIGS. 6A-6B illustrates a surface-mount antenna, an antenna device, and their characteristics according to a third embodiment.

FIG. 6A is an exploded perspective view illustrating the surface-mount antenna of the third embodiment. This surface-mount antenna is obtained by adding another layer of ferroelectric substrate 50 to the surface-mount antenna of FIG. 2. An electrode 51 is formed over the entire upper surface of the ferroelectric substrate 50. The electrode 51 is grounded via a resistor R of high value.

An extraction electrode 36 is formed in the center of the right-rear end surface of the ferroelectric substrate 30. The extraction electrode 36 allows an end of the inductor electrode 34 to be grounded to the ground electrode 31.

By providing the resistor R or an inductor of high value between the electrode 51 on the ferroelectric substrate 50 and the ground, the upper-surface radiating electrode 41 on the paraelectric substrate 40 is brought to, for example, a positive potential, the electrode 51 on the ferroelectric substrate 50 is brought to a zero potential, and a voltage can be applied to the ferroelectric substrate 50. Since the electrode 51 on the ferroelectric substrate 50 is grounded via the resistor R or inductor of high value, the electrode 51 is opened and not grounded at high frequencies.

With this configuration, the upper-surface radiating electrode 41 on the paraelectric substrate 40 acts as an excitation electrode which excites the electrode 51 on the ferroelectric substrate 50, and both the upper-surface radiating electrode 41 and the electrode 51 act as radiating electrodes. That is, a patch antenna of a capacitance feeding type is made.

In this example, the upper-surface radiating electrode 41 is in contact with the ferroelectric substrate 50. However, by reducing the thickness of the ferroelectric substrate 50, loss caused by contact with ferroelectrics can be reduced to some extent. In this example, the size of the ferroelectric substrate 50 positioned above the ferroelectric substrate 30 is the same as the size of the paraelectric substrate 40. However, if the size of the ferroelectric substrate 50 is smaller than that of the paraelectric substrate 40, the efficiency of radiation from the upper-surface radiating electrode 41 on the paraelectric substrate 40 is improved.

As described above, both the electrode 51 on the ferroelectric substrate 50 and the electrode 41 on the paraelectric substrate 40 act as radiating electrodes. This means that there are provided two resonant circuits that resonate over a wide range of frequencies. This allows the antenna to cover a wider range of frequencies.

Figure 6B:
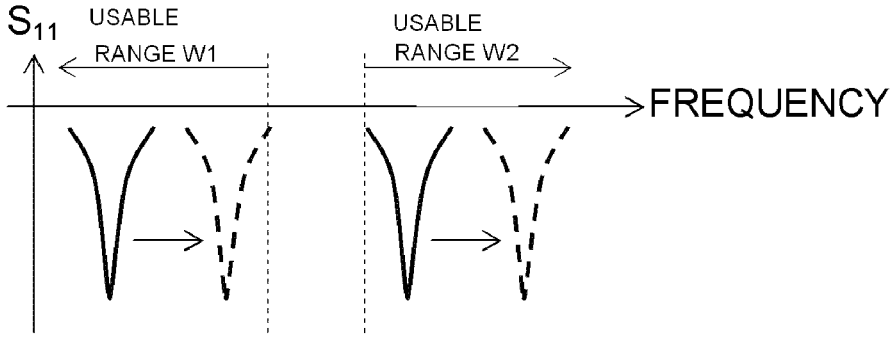

FIG. 6B illustrates the widening of the frequency range. In FIG. 6B, a frequency band W1 including frequencies at which a resonant circuit corresponding to the upper-surface radiating electrode 41 on the paraelectric substrate 40 (i.e., a resonant circuit including the paraelectric substrate 40, the upper-surface radiating electrode 41, the ferroelectric substrate 30, and the ground electrode 31) resonates and a frequency band W2 including frequencies at which a resonant circuit corresponding to the electrode 51 on the ferroelectric substrate 50 (i.e., a resonant circuit including the ferroelectric substrate 50, the electrode 51, the paraelectric substrate 40, the ferroelectric substrate 30, and the ground electrode 31) resonates are represented by an S11—characteristic of S-parameters. By applying a control voltage to the ferroelectric substrate 50, these resonant frequency bands are entirely frequency-shifted as indicated by arrows in the drawing. Thus, by making the two resonant frequency bands substantially continuous, the antenna can cover a still wider range of frequencies.

Fourth Embodiment

A surface-mount antenna according to a fourth embodiment will now be described with reference to FIG. 7.

Figure 7:
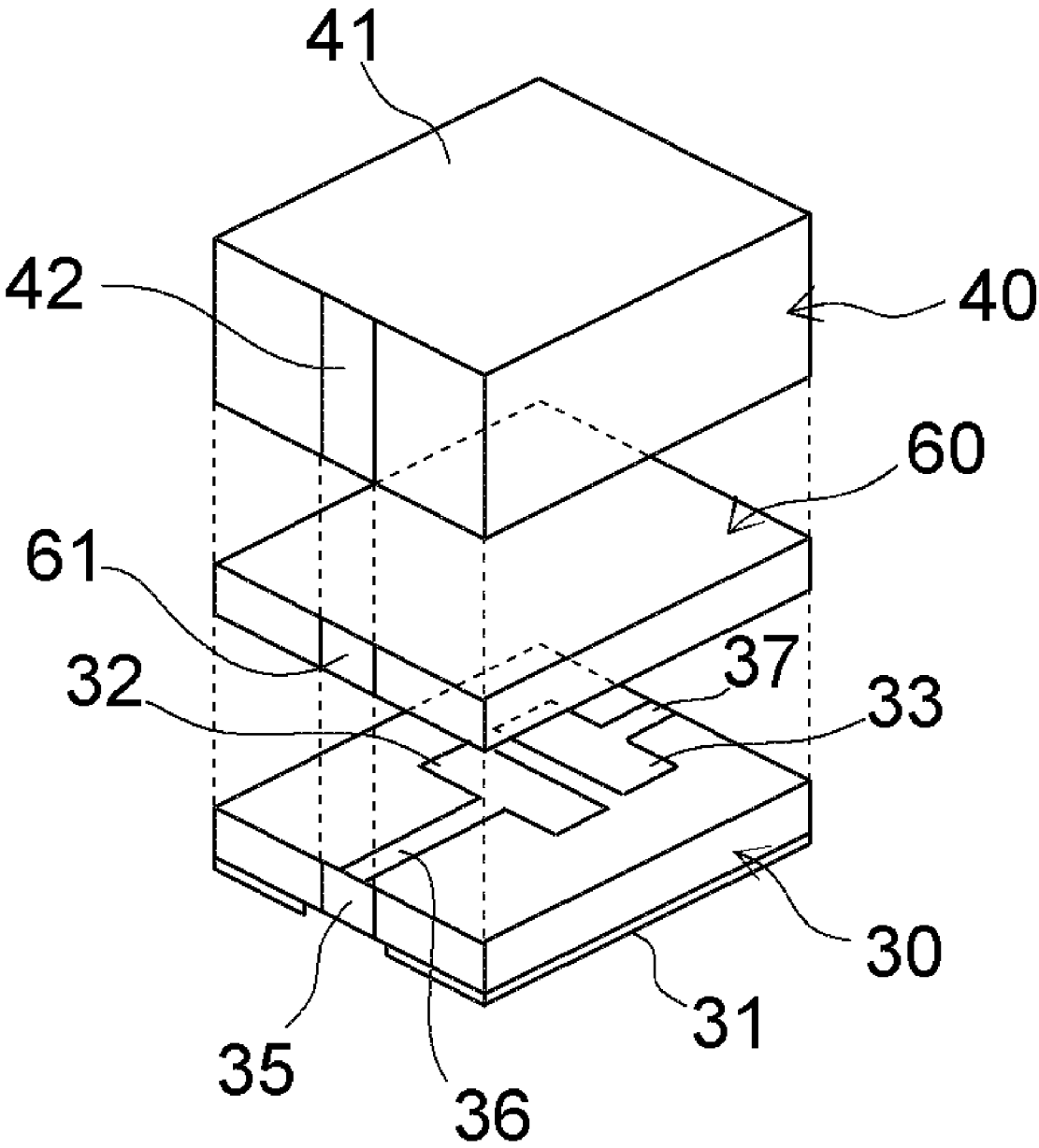
FIG. 7 illustrates a configuration of a surface-mount antenna according to a fourth embodiment.

FIG. 7 is an exploded perspective view of the surface-mount antenna. The surface-mount antenna of FIG. 7 is different from the surface-mount antenna illustrated in FIG. 2 in that a ferroelectric substrate 60 is interposed between the ferroelectric substrate 30 and the paraelectric substrate 40. An electrode 61 is formed in the center of an end surface (located at the left front of the drawing) of the ferroelectric substrate 60. With the ferroelectric substrates 30 and 60 and the paraelectric substrate 40 stacked in layers, the end-surface radiating electrode 42 is electrically connected to the extraction electrode 35 via the electrode 61.

In this example, an extraction electrode 37 electrically connected to the second capacitor electrode 33 is formed on the upper surface of the ferroelectric substrate 30. The extraction electrode 37 is electrically connected to another extraction electrode, which extends from an end surface to part of the lower surface of the ferroelectric substrate 30 and is connected to an inductor mounted on a mounting board.

Configurations of a power feeding circuit and a control-voltage applying circuit for the surface-mount antenna of FIG. 7, and an equivalent circuit of an antenna device including the surface-mount antenna, the power feeding circuit, and the control-voltage applying circuit are identical to those illustrated in FIGS. 2A-2D.

Thus, by providing the ferroelectric substrate 60, which is a ferroelectric layer, over the ferroelectric substrate 30 having the first and second capacitor electrodes 32 and 33 thereon, it is possible to increase the capacitance between the first and second capacitor electrodes 32 and 33 and to improve the effect of the voltage dependence of the dielectric constant.

Fifth Embodiment

A surface-mount antenna according to a fifth embodiment will now be described with reference to FIG. 8.

Figure 8:
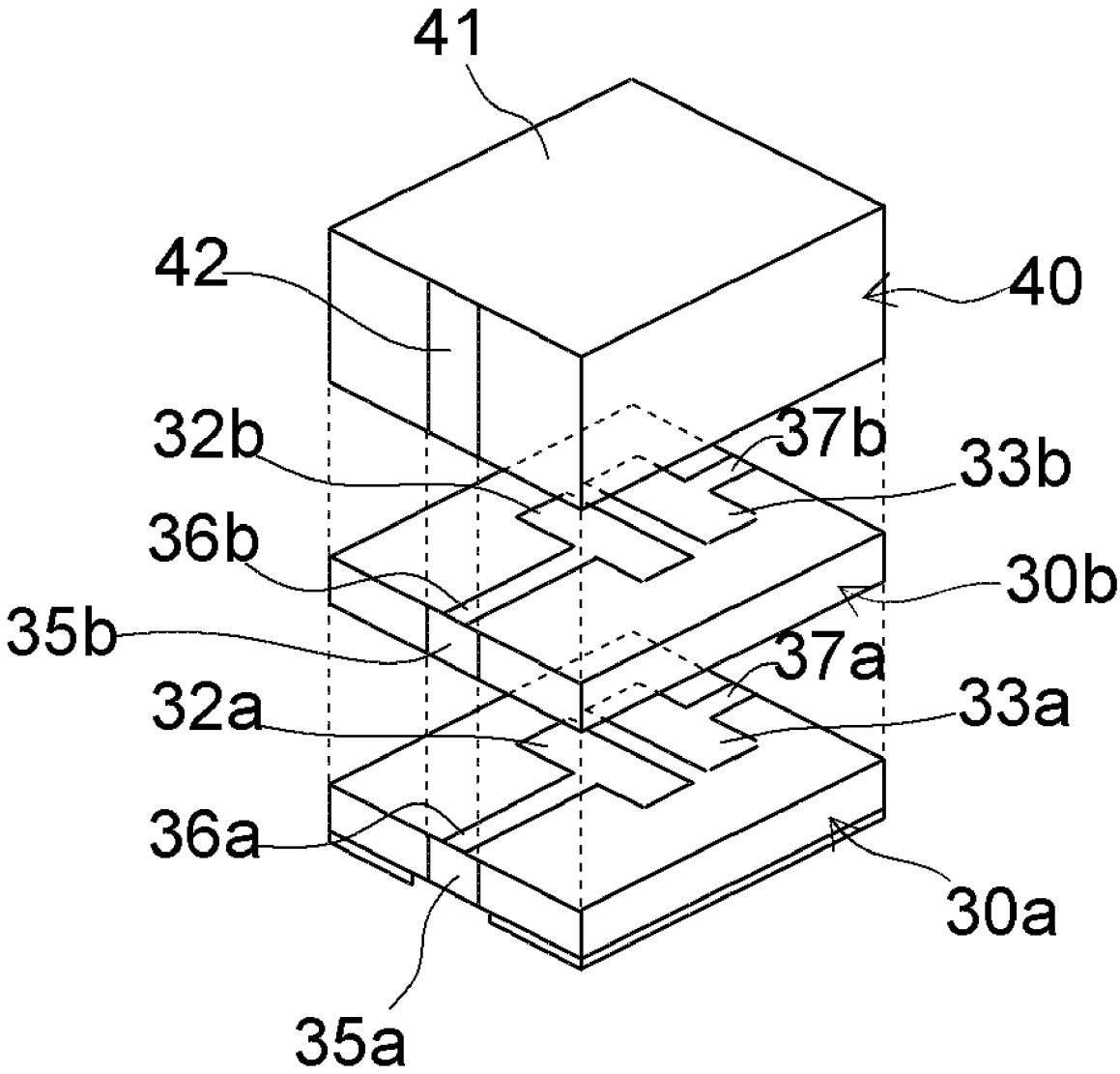
FIG. 8 illustrates a configuration of a surface-mount antenna according to a fifth embodiment.

FIG. 8 is an exploded perspective view of the surface-mount antenna. The surface-mount antenna of FIG. 8 is different from the surface-mount antenna illustrated in FIG. 2 in that two ferroelectric substrates 30*a* and 30*b* are provided.

A first capacitor electrode 32*a*, a second capacitor electrode 33*a*, and extraction electrodes 36*a* and 37*a* are formed on the upper surface of the ferroelectric substrate 30*a*. Similarly, a first capacitor electrode 32*b*, a second capacitor electrode 33*b*, and extraction electrodes 36*b* and 37*b* are formed on the upper surface of the ferroelectric substrate 30*b*. Additionally, an extraction electrode 35*a* electrically connected to the extraction electrode 36*a* is formed in the center of an end surface (located at the left front of the drawing) of the ferroelectric substrate 30*a*. Also, an extraction electrode 35*b* electrically connected to the extraction electrode 36*b* is formed in the center of an end surface (located at the left front of the drawing) of the ferroelectric substrate 30*b*. Similarly, an extraction electrode electrically connected to the extraction electrode 37*a* is formed in the center of an end surface (located at the right rear of the drawing) of the ferroelectric substrate 30*a*. Also, an extraction electrode electrically connected to the extraction electrode 37*b* is formed in the center of an end surface (located at the right rear of the drawing) of the ferroelectric substrate 30*b*.

An electrode electrically connected to the extraction electrode 35*a* on the left-front end surface of the ferroelectric substrate 30*a* and another electrode electrically connected to the extraction electrode on the right-rear end surface of the ferroelectric substrate 30*a* are formed on part of the lower surface of the ferroelectric substrate 30*a*.

Configurations of a power feeding circuit and a control-voltage applying circuit for the surface-mount antenna of FIG. 8, and an equivalent circuit of an antenna device including the surface-mount antenna, the power feeding circuit, and the control-voltage applying circuit are identical to those illustrated in FIGS. 2A-2D.

Thus, by separating each of the first and second capacitor electrodes 32 and 33 into multiple layers, it is possible to increase the capacitance between the first and second capacitor electrodes 32 and 33 and to improve the effect of the voltage dependence of the dielectric constant.

Sixth Embodiment

A surface-mount antenna according to a sixth embodiment will now be described with reference to FIGS. 9A-9B.

Figure 9A:
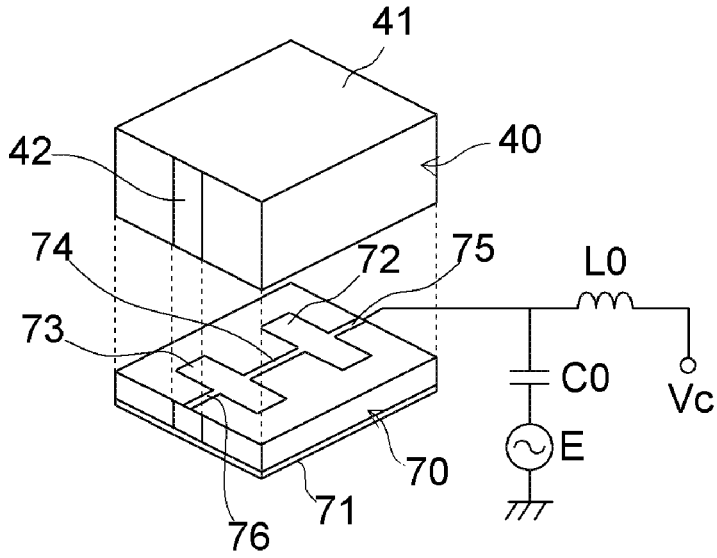
FIGS. 9A-9B illustrate a surface-mount antenna, an antenna device, and an equivalent circuit of the antenna device according to a sixth embodiment.

FIG. 9A is an exploded perspective view of the surface-mount antenna. FIG. 9B is an equivalent circuit diagram of an antenna device including the surface-mount antenna.

A ground electrode 71 is formed on substantially the entire lower surface of a ferroelectric substrate 70. A first capacitor electrode 72 and a second capacitor electrode 73 are formed on the upper surface of the ferroelectric substrate 70. Capacitances are formed between the ground electrode 71 and the first and second capacitor electrodes 72 and 73. An inductor electrode 74 which connects the two capacitor electrodes 72 and 73 is also formed on the upper surface of the ferroelectric substrate 70. Additionally, an extraction electrode 75 connected to the first capacitor electrode 72 and an extraction electrode 76 connected to the second capacitor electrode 73 are formed on the upper surface of the ferroelectric substrate 70. Another extraction electrode electrically connected to the extraction electrode 75 extends from the right-rear end surface to part of the lower surface of the ferroelectric substrate 70.

The upper-surface radiating electrode 41 is formed over the entire upper surface of the paraelectric substrate 40. The end-surface radiating electrode 42 is formed in the center of the left-front end surface of the paraelectric substrate 40. With the paraelectric substrate 40 and the ferroelectric substrate 70 stacked in layers, the end-surface radiating electrode 42 is electrically connected to the extraction electrode 75.

Figure 9B:
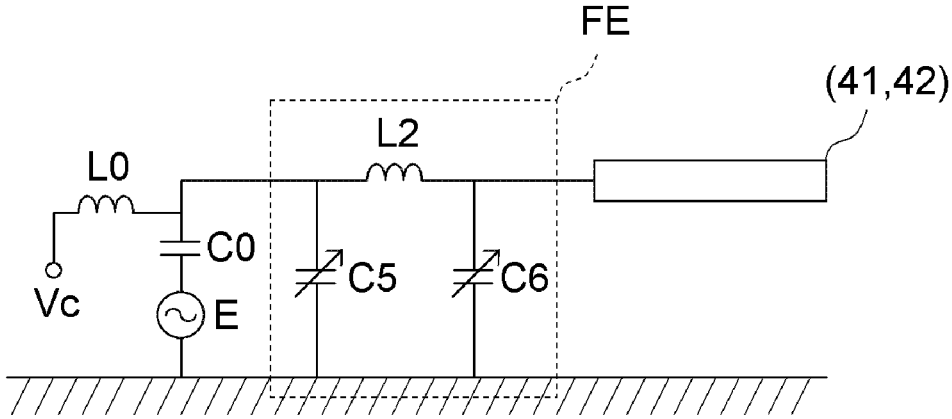

In FIG. 9B, an inductor L2 represents the inductor formed by the inductor electrode 74, and capacitors C5 and C6 represent capacitances formed between the ground electrode 71 and the first and second capacitor electrodes 72 and 73.

Although the radiating electrodes (41, 42) are represented as simple transmission lines, an equivalent circuit of the radiating electrodes in this example is the same as those illustrated in FIG. 2C and FIG. 2D. In FIG. 9B, a circuit enclosed with dashed line FE is a CLC $\pi$-type low-pass filter circuit acting as an impedance matching circuit. Since the impedance matching circuit is formed in the ferroelectric substrate, the impedance of the impedance matching circuit changes in response to a voltage because of the voltage dependence of the dielectric constant. Therefore, it is possible, over a wide range of frequencies, to achieve impedance matching between the power feeding circuit and the antenna unit and obtain high-gain and low-reflection characteristics.

Seventh Embodiment

A surface-mount antenna according to a seventh embodiment will now be described with reference to FIGS. 10A-10B.

Figure 10A:
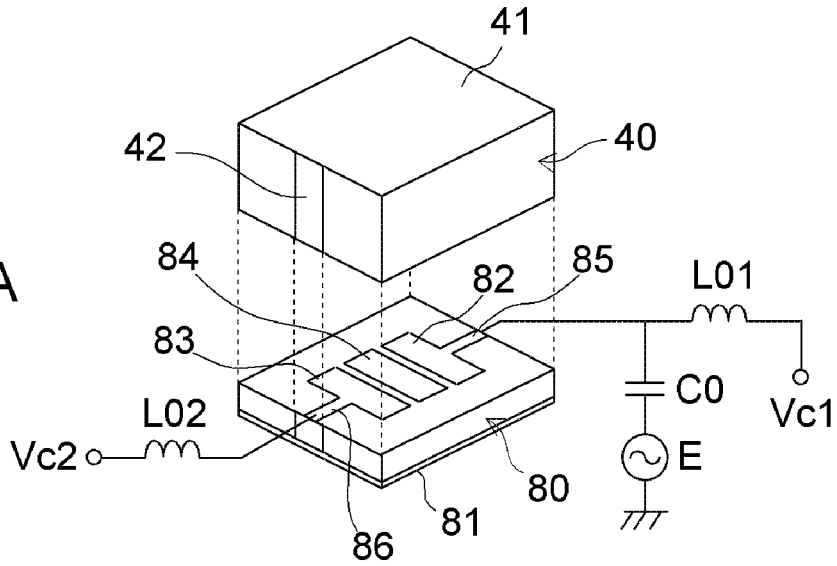
FIGS. 10A-10B illustrate a surface-mount antenna, an antenna device, and an equivalent circuit of the antenna device according to a seventh embodiment.

FIG. 10A is an exploded perspective view of the surface-mount antenna. FIG. 10B is an equivalent circuit diagram of an antenna device including the surface-mount antenna.

The upper surface of a ferroelectric substrate 80 is provided with an inductor electrode 84 which forms capacitances between itself and first and second capacitor electrodes 82 and 83 and also forms an inductor between itself and a ground electrode 81. For example, a via hole is formed in the ferroelectric substrate 80 and used as an inductor. Alternatively, the ferroelectric substrate 80 may have a multilayer structure provided with a wound inductor.

In this example, a first control voltage Vc1 is applied to the first capacitor electrode 82 via an inductor Lo1, and a second control voltage Vc2 is applied to the second capacitor electrode 83 via an inductor Lo2.

Figure 10B:
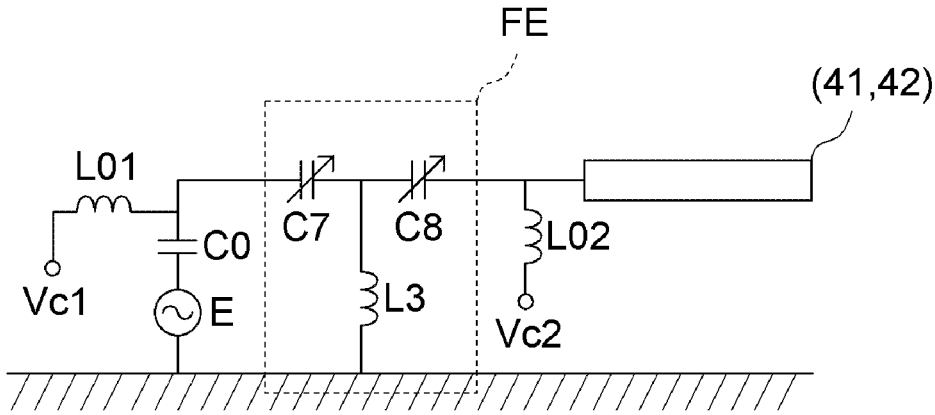

In FIG. 10B, a circuit enclosed with dashed line FE is a CLC T-type high-pass filter circuit acting as an impedance matching circuit. The control voltage Vc1 is applied to a capacitor C7 and the control voltage Vc2 is applied to a capacitor C8. Thus, by applying two different control voltages, the impedance of the impedance matching circuit can be controlled. With this configuration, the first and second control voltages Vc1 and Vc2 may be equal (Vc1=Vc2) in some applications.

The impedance of the impedance matching circuit changes in response to a voltage because of the voltage dependence of the dielectric constant. Therefore, it is possible, over a wide range of frequencies, to achieve impedance matching between the power feeding circuit and the antenna unit and obtain high-gain and low-reflection characteristics.

Eighth Embodiment

A surface-mount antenna according to an eighth embodiment will now be described with reference to FIGS. 11A-11B.

Figure 11A:
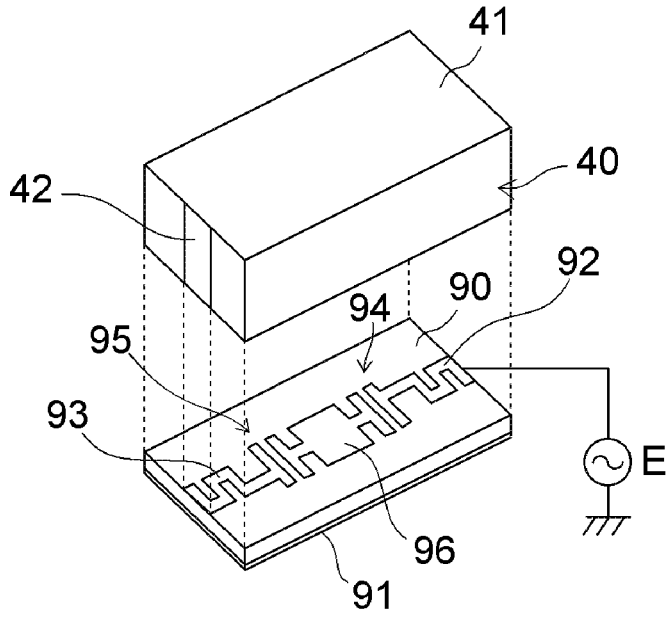
FIGS. 11A-11B illustrate a surface-mount antenna and an equivalent circuit of the surface-mount antenna according to an eighth embodiment.

FIG. 11A is an exploded perspective view of the surface-mount antenna. FIG. 11B is an equivalent circuit diagram of an antenna device including the surface-mount antenna.

The upper surface of a ferroelectric substrate 90 is provided with two capacitor electrode pairs 94 and 95, a capacitor electrode 96 connected between the first and second capacitor electrode pairs 94 and 95 and forming a capacitance between itself and a ground electrode 91 on the lower surface of the ferroelectric substrate 90, and a first inductor electrode 92 and a second inductor electrode 93 connected to the first and second capacitor electrode pairs 94 and 95, respectively.

The upper-surface radiating electrode 41 is formed over the entire upper surface of the paraelectric substrate 40. The end-surface radiating electrode 42 is formed in the center of the left-front end surface of the paraelectric substrate 40. With the paraelectric substrate 40 and the ferroelectric substrate 90 stacked in layers, the end-surface radiating electrode 42 is electrically connected to the second inductor electrode 93.

Figure 11B:
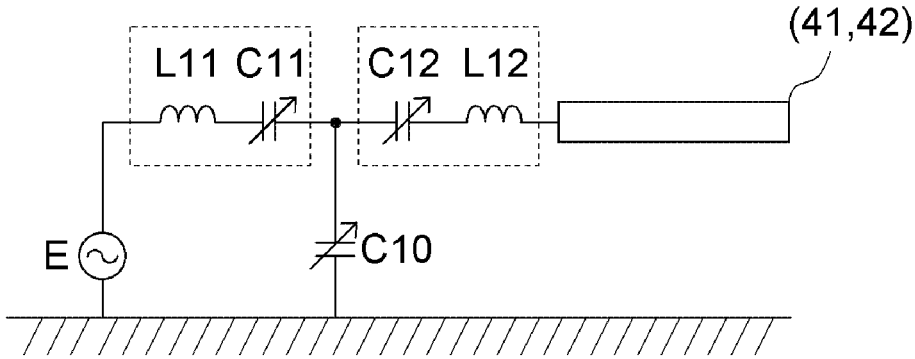

In FIG. 11B, a capacitor C11 represents the capacitance of the first capacitor electrode pair 94, and a capacitor C12 represents the capacitance of the second capacitor electrode pair 95. A capacitor C10 represents the capacitance formed between the capacitor electrode 96 and the ground electrode 91. An inductor L11 represents the inductor formed by the first inductor electrode 92, and an inductor L12 represents the inductor formed by the second inductor electrode 93. In a serial circuit composed of the inductor L11 and the capacitor C11 and a serial circuit composed of the capacitor C12 and the inductor L12, the circuit constants are determined such that these serial circuits look inductive. Therefore, these serial circuits and the capacitor C10 constitute an LCL T-type low-pass filter circuit, which acts as an impedance matching circuit.

Since the capacitors C10, C11, and C12 of the impedance matching circuit are formed in the ferroelectric substrate 90, the impedance of the impedance matching circuit changes in response to a voltage because of the voltage dependence of the dielectric constant. Therefore, it is possible, over a wide range of frequencies, to achieve impedance matching between the power feeding circuit and the antenna unit and obtain high-gain and low-reflection characteristics.

Ninth Embodiment

A surface-mount antenna according to a ninth embodiment of the present will now be described with reference to FIGS. 12A-12B.

Figure 12A:
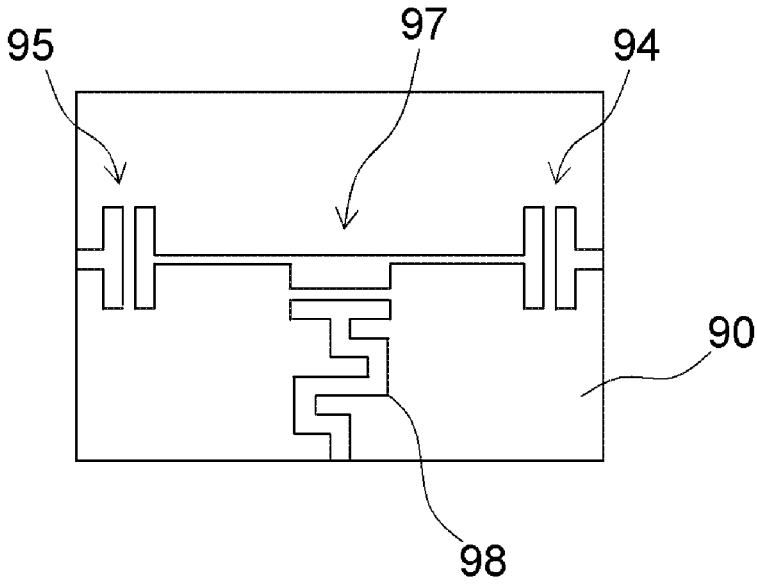
FIGS. 12A-12B illustrate a surface-mount antenna and an equivalent circuit of the surface-mount antenna according to a ninth embodiment.

FIG. 12A is a plan view of the ferroelectric substrate 90 included in the surface-mount antenna. FIG. 12B is an equivalent circuit diagram of an antenna device including the surface-mount antenna.

The upper surface of the ferroelectric substrate 90 is provided with the first capacitor electrode pair 94, the second capacitor electrode pair 95, and a third capacitor electrode pair 97, each pair having first and second electrodes facing each other on the upper surface of the ferroelectric substrate 90 to form a capacitance therebetween. The first electrodes of these capacitor electrode pairs are connected to each other to form a common electrode. The upper surface of the ferroelectric substrate 90 is further provided with an inductor electrode 98 connected between the third capacitor electrode pair 97 and a ground electrode on the lower surface of the ferroelectric substrate 90. The lower surface of the ferroelectric substrate 90 is substantially entirely covered with the ground electrode.

The configuration of a paraelectric substrate stacked on top of the ferroelectric substrate 90 is the same as that illustrated in FIG. 11A.

With the paraelectric substrate stacked on top of the ferroelectric substrate 90, an end-surface radiating electrode is electrically connected to an electrode outside the second capacitor electrode pair 95. Then, power is fed to an electrode outside the first capacitor electrode pair 94.

Figure 12B:
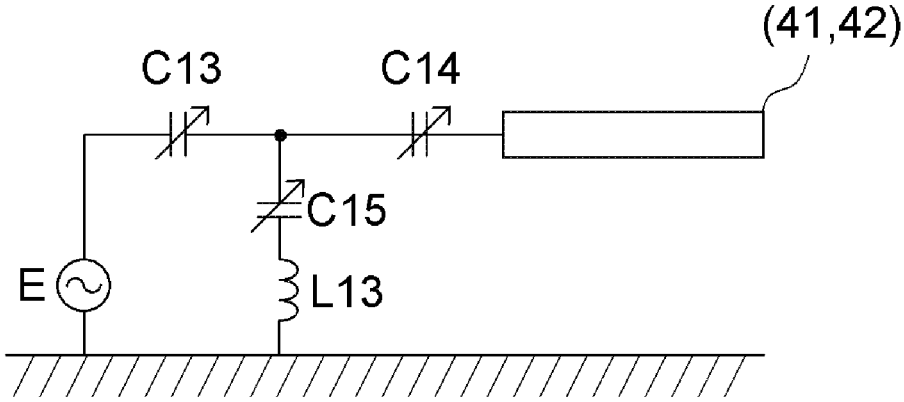

In FIG. 12B, a capacitor C13 represents the capacitance of the first capacitor electrode pair 94, a capacitor C14 represents the capacitance of the second capacitor electrode pair 95, and a capacitor C15 represents the capacitance of the third capacitor electrode pair 97. An inductor L13 represents the inductor formed by the inductor electrode 98.

In a serial circuit composed of the capacitor C15 and the inductor L13, the circuit constant is determined such that the serial circuit looks capacitive. Therefore, this serial circuit and the capacitors C13 and C14 constitute a CLC T-type high-pass filter circuit, which acts as an impedance matching circuit.

The impedance matching circuit is formed by a filter circuit in the sixth to ninth embodiments described above. Alternatively, the impedance matching circuit may be formed by a phase shifter. That is, the impedance matching circuit may be formed by any circuit which at least includes a control electrode and a ground electrode and is formed in a ferroelectric substrate.

Radiating electrodes formed in a paraelectric substrate are not limited to those constituting an L-shaped antenna, and may be those constituting an inverted-F antenna.

Although particular embodiments have been described, many other variations and modifications and other uses will become apparent to those skilled in the art. Therefore, the present invention is not limited by the specific disclosure herein.

What is claimed is:

1. A surface-mount antenna comprising a ferroelectric substrate and a paraelectric substrate that are stacked in layers, wherein the ferroelectric substrate is provided with a control electrode and a ground electrode, while the ferroelectric substrate, the ground electrode, and the control electrode constitute an impedance matching circuit; and a surface of the paraelectric substrate is provided with radiating electrodes and, with the paraelectric substrate and the ferroelectric substrate stacked in layers.

2. The surface-mount antenna according to claim 1, wherein the ferroelectric substrate has two principal surfaces substantially parallel to each other, and the control electrode and the ground electrode are formed at respective positions of the two principal surfaces such that the ferroelectric substrate is interposed between the control electrode and the ground electrode.

3. The surface-mount antenna according to claim 1, wherein there is a plurality of ferroelectric substrates stacked in layers, each ferroelectric substrate having two principal surfaces substantially parallel to each other, and the control electrode is formed on one principal surface of each of the plurality of ferroelectric substrates such that capacitances generated between the ground electrode and the control electrodes are connected in parallel.

4. The surface-mount antenna according to claim 3, wherein the plurality of ferroelectric substrates includes at least two ferroelectric substrates with different ferroelectric properties.

5. The surface-mount antenna according to any one of claims 1 to 4, wherein the ground electrode is formed on one principal surface of the ferroelectric substrate distant from the paraelectric substrate, while the control electrode includes a first capacitor electrode, a second capacitor electrode, and an inductor electrode connected to the second capacitor electrode or a connecting portion connected to an external inductor, the first and second capacitor electrodes facing each other on the other principal surface of the ferroelectric substrate to form a capacitance therebetween and individually facing the ground electrode to form capacitances between the ground electrode and the first and second capacitor electrodes; and the radiating electrodes include an electrode extending from one principal surface of the paraelectric substrate distant from the ferroelectric substrate to an end surface of the paraelectric substrate, and the electrode on the end surface is connected to the first capacitor electrode.

6. The surface-mount antenna according to any one of claims 1 to 4, wherein the ground electrode is formed on one principal surface of the ferroelectric substrate distant from the paraelectric substrate, while the control electrode includes, on the other principal surface of the ferroelectric substrate, a first capacitor electrode, a second capacitor electrode, and an inductor electrode connecting the first and second capacitor electrodes individually facing the ground electrode to form capacitances between the ground electrode and the first and second capacitor electrodes; and the radiating electrodes include an electrode extending from one principal surface of the paraelectric substrate distant from the ferroelectric substrate to an end surface of the paraelectric substrate, and the electrode on the end surface is connected to the first or second capacitor electrode.

7. The surface-mount antenna according to any one of claims 1 to 4, wherein the ground electrode is formed on one principal surface of the ferroelectric substrate distant from the paraelectric substrate, while the control electrode includes, on the other principal surface of the ferroelectric substrate, a first capacitor electrode, a second capacitor electrode, and an inductor electrode, the first and second capacitor electrodes individually facing the ground electrode to form capacitances between the ground electrode and the first and second capacitor electrodes, the inductor electrode forming capacitances between the inductor electrode and the first and second capacitor electrodes and forming an inductor between the inductor electrode and the ground electrode; and the radiating electrodes include an electrode extending from one principal surface of the paraelectric substrate distant from the ferroelectric substrate to an end surface of the paraelectric substrate, and the electrode on the end surface is connected to the first or second capacitor electrode.

8. The surface-mount antenna according to any one of claims 1 to 4, wherein the ground electrode is formed on one principal surface of the ferroelectric substrate distant from the paraelectric substrate, while the control electrode includes a first capacitor electrode pair, a second capacitor electrode pair, a capacitor electrode, a first inductor electrode, and a second inductor electrode, the first and second capacitor electrode pairs each having first and second electrodes facing each other on the other principal surface of the ferroelectric substrate to form a capacitance therebetween, the capacitor electrode being connected between the first and second capacitor electrode pairs and facing the ground electrode to form a capacitance between the capacitor electrode and the ground electrode, the first and second inductor electrodes being connected to the first and second capacitor electrode pairs, respectively; and the radiating electrodes include an electrode extending from one principal surface of the paraelectric substrate distant from the ferroelectric substrate to an end surface of the paraelectric substrate, and the electrode on the end surface is connected to the first or second inductor electrode.

9. The surface-mount antenna according to any one of claims 1 to 4, wherein the ground electrode is formed on one principal surface of the ferroelectric substrate distant from the paraelectric substrate, while the control electrode includes a first capacitor electrode pair, a second capacitor electrode pair, a third capacitor electrode pair, and an inductor electrode, the first, second, and third capacitor electrode pairs each having first and second electrodes facing each other on the other principal surface of the ferroelectric substrate to form a capacitance therebetween, the first electrodes of the first, second, and third capacitor electrode pairs being connected to each other to form a common electrode, the inductor electrode connected between the ground electrode and the second electrode of the third capacitor electrode pair; and the radiating electrodes include an electrode extending from one principal surface of the paraelectric substrate distant from the ferroelectric substrate to an end surface of the paraelectric substrate, and the electrode on the end surface is connected to the second electrode of the first or second capacitor electrode pair.

10. An antenna device comprising a surface-mount antenna according to any one of claims 1 to 4, and further comprising a circuit for applying a DC control voltage to the control electrode of the surface-mount antenna.

* * * * *